US005134951A

United States Patent [19]

Nishimura

[11] Patent Number: 5,134,951

[45] Date of Patent: Aug. 4, 1992

[54] HARNESS LINE APPARATUS FOR WIND PROPELLED VEHICLES

[75] Inventor: Thomas G. Nishimura, Honolulu, Hi.

[73] Assignee: Avatar Technologies, Honolulu, Hi.

[21] Appl. No.: 600,313

[22] Filed: Oct. 18, 1990

[51] Int. Cl.[5] ..... B63B 35/00

[52] U.S. Cl. ..... 114/39.2; 182/3

[58] Field of Search ..... 114/39.1, 39.2, 89, 114/90, 91, 92, 93; 182/3; 24/305, 481

[56] References Cited

U.S. PATENT DOCUMENTS

| | | | |
|---|---|---|---|
| 4,112,865 | 9/1978 | Carn | 114/270 |
| 4,235,182 | 11/1980 | Burger | 440/34 |
| 4,418,631 | 12/1988 | Frohbach | 114/39 |
| 4,458,617 | 7/1984 | Eden | 114/39 |
| 4,480,567 | 11/1984 | Silfversparre | 114/39 |
| 4,505,216 | 3/1985 | Elorza | 114/39 |
| 4,516,295 | 5/1985 | McCoy | 24/136 |
| 4,763,591 | 8/1988 | Taylor | 114/39.2 |

FOREIGN PATENT DOCUMENTS

| | | | |
|---|---|---|---|
| 3232908 | 3/1984 | Fed. Rep. of Germany | 114/39.2 |
| 3248159 | 6/1984 | Fed. Rep. of Germany | 114/39.2 |
| 2610591 | 8/1988 | France | 114/39.2 |

*Primary Examiner*—Jesus D. Sotelo
*Assistant Examiner*—Stephen P. Avila
*Attorney, Agent, or Firm*—Seth M. Reiss

[57] ABSTRACT

An improved harness line apparatus for windsurf and other wind propelled vehicles having an elongated U-shaped curvilinear harness line made of stiff and resilient material. The ends of the stiff harness line are firmly secured to selected points along a wishbone configured boom to withstand gravitational and inertial forces. The harness line extends from the boom towards the sailor and is curved downward such that the middle of the harness line is in close proximity to but just below the harness hook when the sailing vehicle is upright and the sailor is positioned upright on the vehicle. As the sailor leans back into the wind, the sail and boom are rotated about a mast-hull pivot, but the relative positioning of harness line to harness hook is preserved. An improved length adjustable harness line is disclosed as are two improved versions of detachable harness lines.

19 Claims, 5 Drawing Sheets

HARNESS LINE APPARATUS FOR WIND PROPELLED VEHICLES

BACKGROUND OF INVENTION

1. Field of Invention

The present invention relates to improvements in harness line apparatus used with sailboards and other wind propelled vehicles. In particular, this invention describes harness line apparatus which are easier to use and more reliable, exacting and versatile than apparatus currently available.

2. Description of the Prior Art

Wind propelled vehicles having surfboard hulls, pivotal masts, and wishbone booms, commonly known as sailboards or windsurf boards, require that the sailor counterbalance the force of the wind on the sail using body weight and muscular effort. Operators of related types of wind propelled vehicles must do similarly. The energy and strength required to sustain operation of these wind propelled vehicles, particularly in moderate or heavy wind conditions, is considerable. Consequently devices designed to minimize the effort, strength and endurance required to sustain operation of such vehicles have been introduced and are now in common use. These devices usually take the form of a harness with hook, worn by the operator, which detachably engages flexible harness lines secured to either side of the wishbone boom. A variety of harnesses and harness lines are now commercially available.

Existing harness apparatus improves substantially the ability of a sailor to sustain operation of the wind propelled vehicles in moderate and heavy wind conditions, but they are not themselves without limitations. Because the sailor's hands are continuously occupied manipulating the boom, the sailor must engage the harness line with hook by moving his body and the boom relative to one another. With existing apparatus the disengaged harness line hangs limply downward and may flap freely or even wrap around the boom during maneuvers, making engagement difficult. Disengagement, which also must be performed without the assistance of hands, is similarly problematic using the presently available apparatus. Silfversparre, U.S. Pat. No. 4,480,567, discloses substantially rigid harness lines which the sailor engages by pivoting the lines around the boom using his thumbs. Though rigid, the lines are free to swing and require the sailors thumbs to be in close proximity to the point where the line attaches the boom. A primary object of this invention is to provide stiff resilient harness lines held firmly in a position which greatly facilitates the engagement and disengagement of the harness hook with the harness line without the use of hands and with minimal movement of the body.

Wind propelled vehicles of the type described have a harness line on each side of the sail, one attached to each half of the wishbone configured boom. The sailor must necessarily disengage the harness hook from line when changing sides of the wind, whether by tacking or jibing, and thereafter re-engage the hook with line on the other side of the sail. During these transitions and in particular during jibes performed under severe conditions, the unoccupied harness lines swing freely interfering with the sailor and can swing with such force as to impact the sailor. Elorza, U.S. Pat. No. 4,505,216, illustrates a harness line held upright by an elastic member. The line is thereby held out of harms way during transitions but is awkwardly positioned and requires manual manipulation for re-engagement. A second object of the present invention is to provide a line held rigid and positioned so that, while unoccupied during maneuvers, it will neither hit nor otherwise interfere with the sailor.

A further characteristic of harness line apparatus is that their size and their positioning relative to the sail must be varied according to the sailor's size and strength, the size of board, mast and sail, and the prevailing sailing conditions. To this end many existing harness lines are adjustable both in terms of the length of available line and the placement of the line along the boom. McCoy, U.S. Pat. No. 4,516,295, discloses a harness line designed to be releasable for adjusting its placement along the boom. Taylor, U.S. Pat. No. 4,763,591, discloses a harness line which includes a pull down strap to vary the length, and therefore size, of the harness line. It is a further object of this invention to provide additional novel mechanisms for adjusting the length of the harness line and for adjusting the line's position longitudinally along the boom.

SUMMARY OF THE INVENTION

These and other objects are accomplished in the present invention, an improved design for harness line apparatus for wind propelled vehicles, comprised of a stiff and resilient elongated curvilinear harness line. The line is secured at each end to selected positions along the boom by an attaching means capable of holding the line rigidly outward and downward relative to an upright sail such that the middle portion of the line is in close proximity to the harness hook when the vehicle is underway and the sailor is positioned upright on the vehicle. The location of the middle of the line in close proximity to the hook facilitates engagement. The stiff quality of the line and the rigid manner the line is held precludes the effects of gravitational force that can act to hamper the hook's disengagement. These qualities also prevent the line from swinging and unintentionally engaging or otherwise interfering with the sailor during maneuvers. Under moderate or heavy wind conditions the sailor must lean back changing the orientation of his body, the sail and the boom. But the positioning of the rigidly held harness line relative to the harness hook is preserved.

A further embodiment comprises harness lines described above wherein the middle portion of each line is curved downward so that, when the vehicle is upright and underway, the line at the point it engages the hook is positioned in close proximity to but slightly below the hook. The line shaped and positioned in this manner prevents unintended engagement and interference with the sailor's body but at the same time leaves the line conveniently located for easy engagement nd disengagement. Because the line is stiff, though still flexible, as well as resilient, it straightens when engaged and under a load, and then resumes its downwardly curved shape once disengaged and unloaded.

According to another embodiment of the invention wherein the size of the line can be varied, the stiff rigid harness line is comprised of two or more sections of stiff but somewhat flexible tubing, the sections having different diameters and being telescoped inside one another. One end of each outside section of tubing is rigidly secured to the boom by way of an attaching means. A continuous length of rope occupies the hollow bores of the tubing and traverses the attaching means. The size of the harness line is determined by the length of rope between the two attaching means and this length can be varied by feeding rope through the attaching means into the telescoped tubes or extracting rope from these tubes, causing the telescoped tubes to slide relative to one another. After a harness line of desired size has been selected, the size of the line is maintained by securing each of the rope ends to the attaching means, to the boom, or to itself.

All the above described embodiments may in addition utilize detachable attaching means which allow the harness lines to be repositioned longitudinally and radially on the boom. While such attaching means can take many forms, two improved forms that are capable of firmly holding stiff harness lines in position are disclosed in this invention. One form of detachable attaching means comprises a band or cincture of flexible material fixed to the end of the harness line which can be wrapped firmly around the boom and be detachably secured to itself using a buckle and Velcro facing. A second improved detachable attaching means comprises a size-adjustable C-shaped clamp body capable of being clamped shut firmly around the boom by way of a hinged lever arm and an inelastic connecting ring.

Further objects and advantages of this invention will become apparent from consideration of the drawings and ensuing description.

BRIEF DESCRIPTION OF THE DRAWINGS

The details of typical, but not limiting, embodiments of the present invention will be described in connection with the accompanying drawings. In the drawings, closely related figures have the same number but different alphabetical suffixes.

REFERENCE NUMBERS IN DRAWINGS

Figure 1:
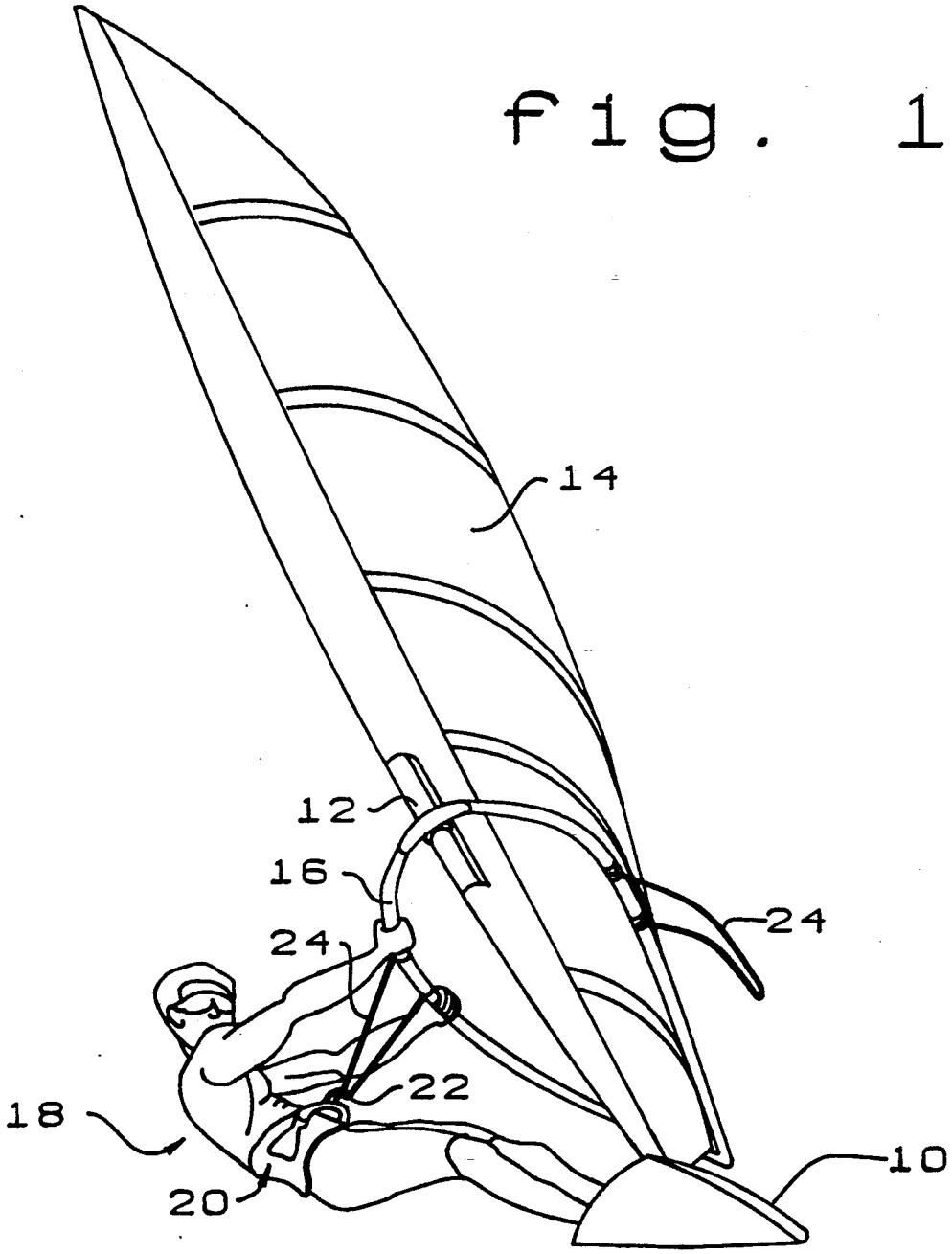
FIG. 1 is a front view of a sailor operating a sailboard wearing a harness engaged in a harness line apparatus.

10: hull
12: pivotal mast
14: sail
16: wishbone boom
18: sailor
20: harness
22: harness hook
24: harness line
26: attaching means
28: rope
30: knot
32: cincture
34: buckle
36: Velcro facing
38: securing device
40: clamp body
42: hinge
44: lever arm
46: connecting ring.

DETAILED DESCRIPTION OF THE PREFERRED EMBODIMENTS

Conventional sailboarding apparatus is illustrated in FIG. 1 consisting of a hull 10, a pivotal mast 12, and a sail 14 sandwiched between a wishbone styled boom 16. Operating the sailboard is a sailor 18 wearing a harness 20 to which is secured a hook 22 engaged in a harness line 24. The ends of harness line 24 are each secured to points along boom 16. The sailor counterbalances the force of the wind on sail 14 by pulling on boom 16 with his hands and by leaning back and producing a load on harness line 24 through harness 20 and harness hook 22. As sailor 18 leans back against the force of the wind, boom 16, harness 20 and hook 22 rotate together around a point formed between hull 10 and pivotal mast 12.

Figure 2:
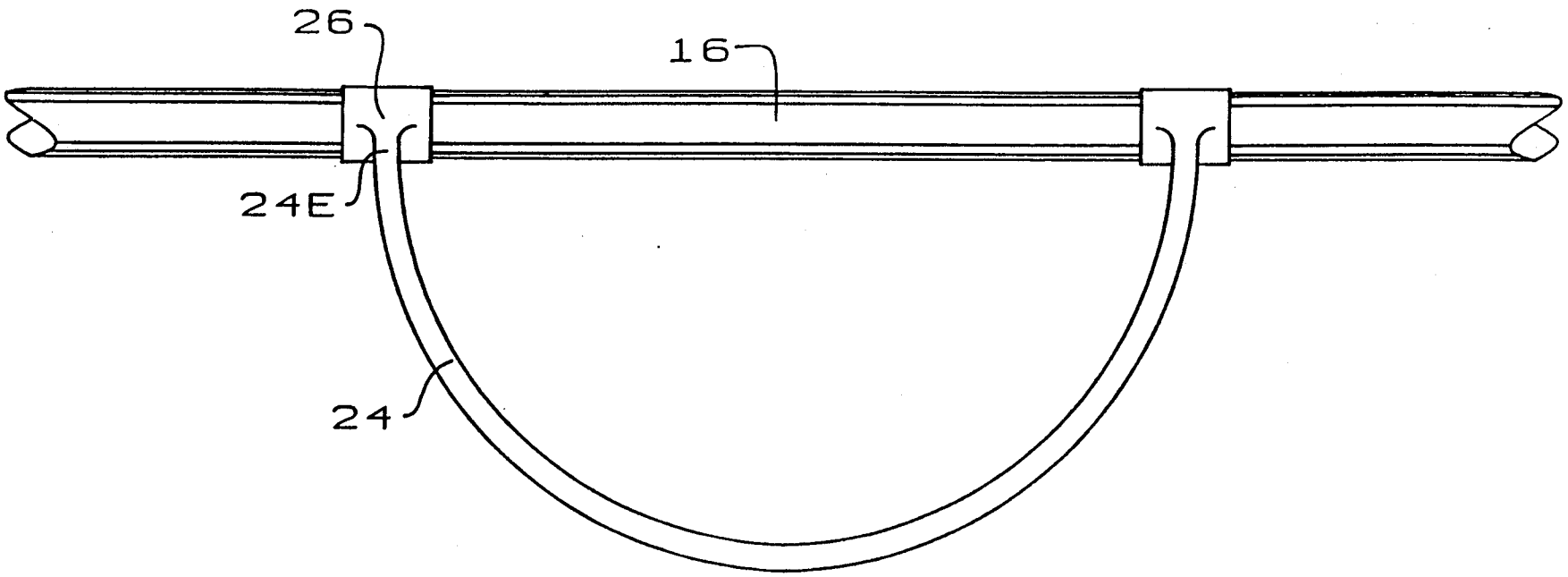
FIG. 2 is a side view of the improved harness line secured to the boom by attaching means.

A side view of one embodiment of the improved harness line apparatus is depicted in FIG. 2. Harness line 24 is composed of a stiff and resilient material and demonstrates an elongated U-shaped curvilinear form with each end 24E being secured to boom 16 at selected points by way of an attaching means 26. Harness line 24 may be constructed from any material or combination of materials which exhibit the necessary stiffness and resiliency such as polyurethane or polyethylene.

Figure 3A:
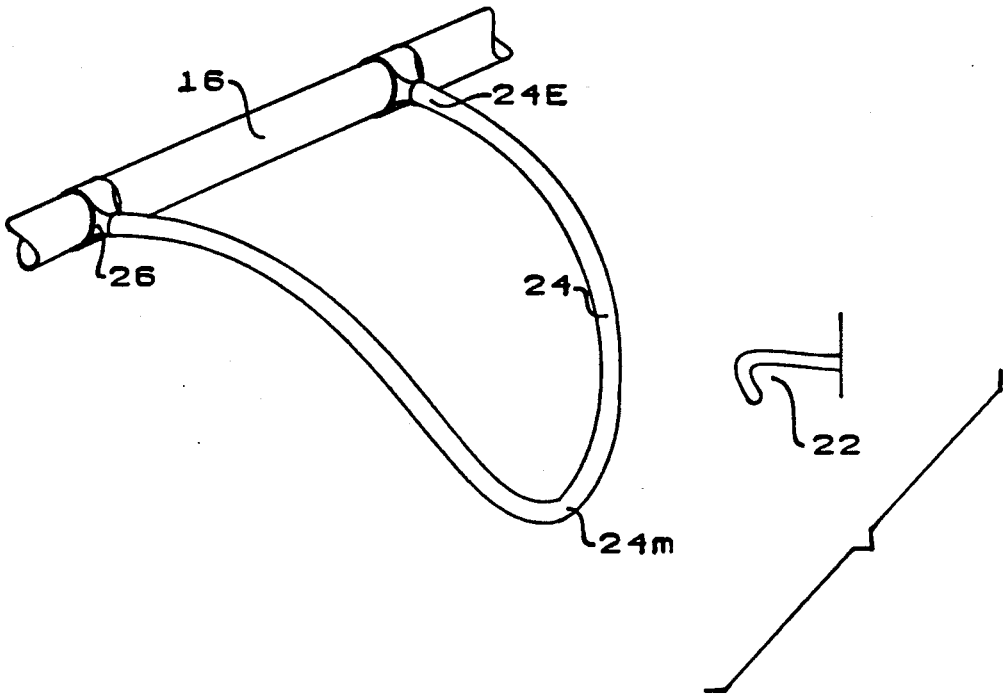
FIGS. 3A and 3B are perspective views of a downwardly curved version of the improved harness line secured to the boom and the line's orientation with respect to the harness hook engaged and disengaged.
Figure 3B:
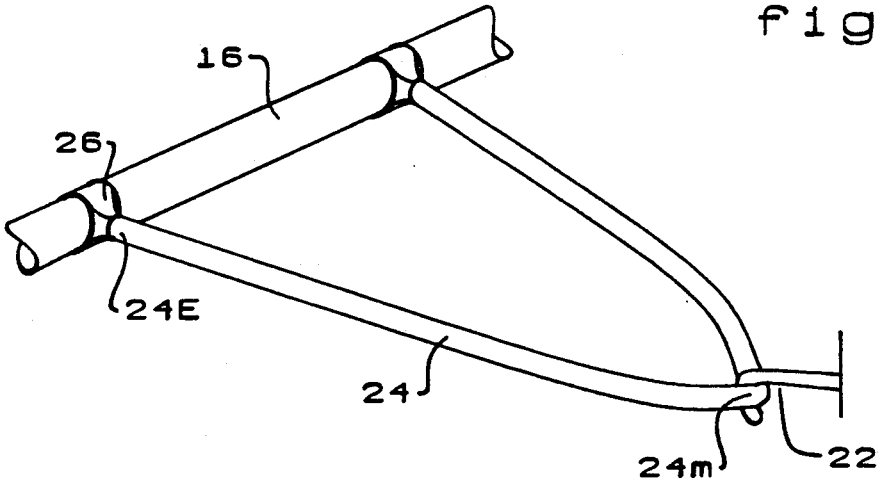

Perspective views of improved harness line 24 with its orientation to harness hook 22 are illustrated in FIGS. 3A and 3B. Ends 24E of the stiff harness line 24 are held firmly in position on boom 16 by attaching means 26 to extend outward away from the boom 16 towards hook 22 and downward at an angle such that, when not engaged and when the sailing vehicle is upright, the middle portion of line 24 al a point **24*m* where it engages hook 22 is positioned in close proximity to hook 22. Attaching means 26 is capable of holding harness line 24 sufficiently rigid to withstand the downward force of gravity and any directional force resulting from high speed maneuvers or severe sailing conditions. While FIG. 2 illustrates a harness line apparatus employing attaching means 26 at both line ends 24E, alternative embodiments are contemplated wherein one attaching means 26 would be sufficient to hold harness line 24 firmly in place. In such embodiments the other end of harness line 24 is joined to boom 16** in any manner capable of securing the load.

FIGS. 3A and 3B also illustrate a preferred embodiment in which the middle portion of line 24 is curved downward relative to the end portions of line 24 such that, when disengaged with the vehicle and sailor upright, point **24*m* of line 24 which engages hook 22 is in close proximity to but slightly below hook 22. The stiffness of harness line 24, the manner in which it is secured firmly in place by attaching means 26, and its positioning and shape relative to hook 22 prevent accidental engagement with hook 22 and make engagement and disengagement with hook 22 easy and reliable. FIG. 3A illustrates harness line 24 unoccupied and bent downward D waiting to be engaged by hook 22. FIG. 3B illustrates harness line 24 engaged in hook 22. When engaged and under load as shown in FIG. 3B, the downwardly bent stiff but still flexible harness line 24 straightens. But because harness line 24 is resilient, line 24 resumes its downwardly bent shape when disengaged and released from the load as demonstrated in FIG. 3A**.

FIGS. 3A and 3B depict the orientation of harness line 24 and harness hook 22 when the vehicle and sailor are both positioned upright. As already described, the sailor effects a rotation of boom 16, harness line 24 and harness hook 22 about the hull-mast pivot when leaning back during moderate and heavy wind conditions. Because stiff harness line 24 is held firmly in place by attaching means 26, the orientation of harness line 24 relative to harness hook 22 will be preserved throughout the rotation. Easy engagement is therefore continuously maintained and the sailor will always have an awareness of the location of the harness line relative to his body.

Figure 4:
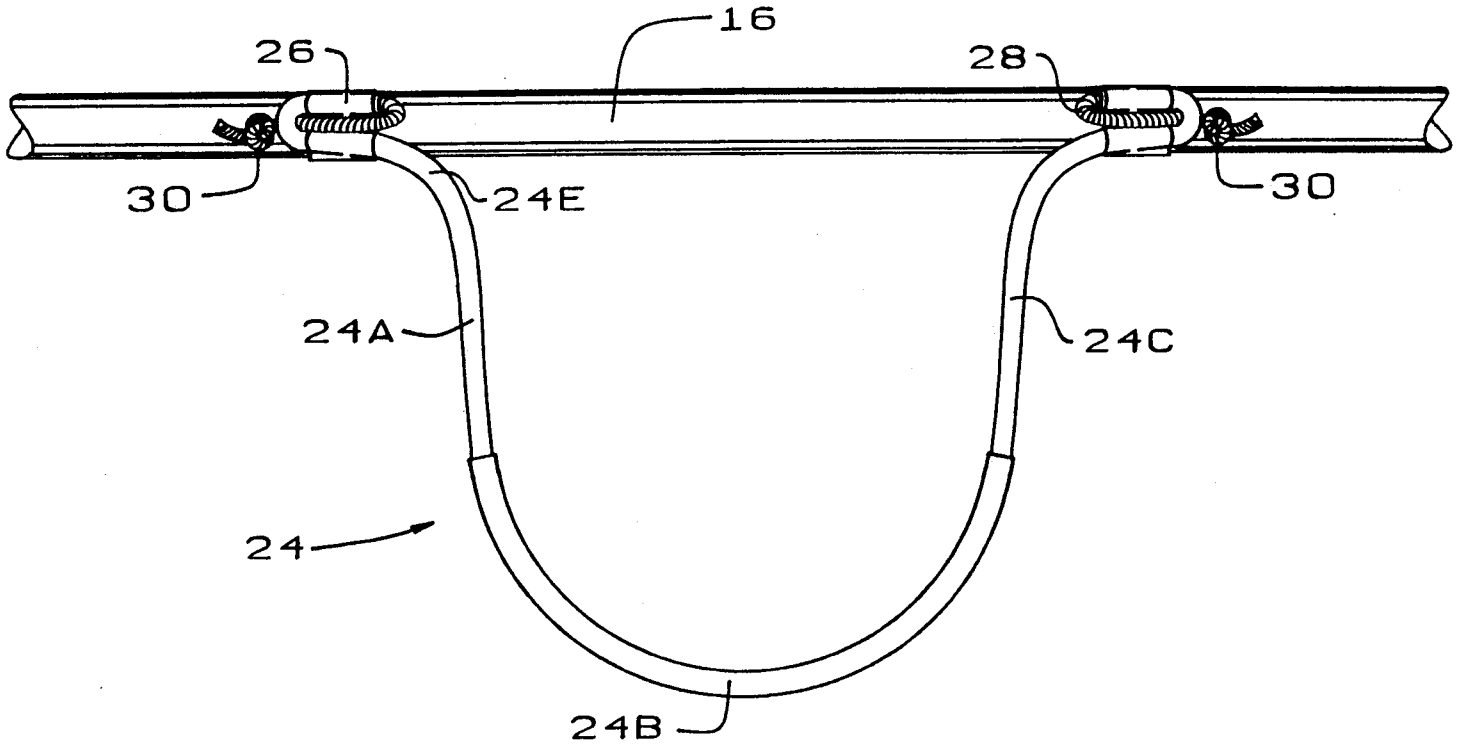
FIG. 4 is a side view of a length adjustable version of the improved harness line employing telescoped tubing.

A preferred embodiment of the improved harness line having an adjustable length is illustrated in FIG. 4. Harness line 24 is formed of three sections of tubing having a rope core. A middle section of tubing 24B has an inside diameter equal to or slightly larger than the outside diameter of the outer sections of tubing 24A and 24C. One end 24E of each outer section tubing 24A and 24C is secured to boom 16 by an attaching means 26 and the other end of each outer section tubing 24A and 24C is telescoped inside the respective ends of middle section tubing 24B. A length of rope 28 occupies the bore of all sections tubing 24A, 24B, and 24C, and traverses attaching means 26 at both ends 24E of line 24. The size of harness line 24 is varied by varying the length of rope 28 which lies between attaching means 26, causing the unsecured ends of outside sections tubing 24A and 24C to slide inside and relative to middle section tubing 24B. Rope 28 is secured in position by the knots 30 at both ends which prevent rope 28 from slipping through attaching means 26 into harness line 24. To increase the size of harness line 24, knot 30 is undone and rope 28 is fed through attaching means 26 into the hollow bore of harness line 24 and thereafter re-knotted. To decrease the size of harness line 24, knot 30 is undone and rope 28 is extracted from the bore of harness line 24 through attaching means 26 and thereafter re-knotted.

Although FIG. 4 discloses a length adjustable telescoping harness line utilizing three sections of tubing, length adjustable harness lines can also be constructed using only two or more than three sections of tubing. Also, while the harness line 24 depicted in FIG. 4 allow for adjustment at both ends, a length adjustable harness line can be constructed with knot 30 at one end only, the other end of rope 28 being more permanently secured. As an alternative to knot 30 shown, rope 28 could be secured to boom 16 or to attaching means 26 by any known mode of detachable securement.

Figure 5A:
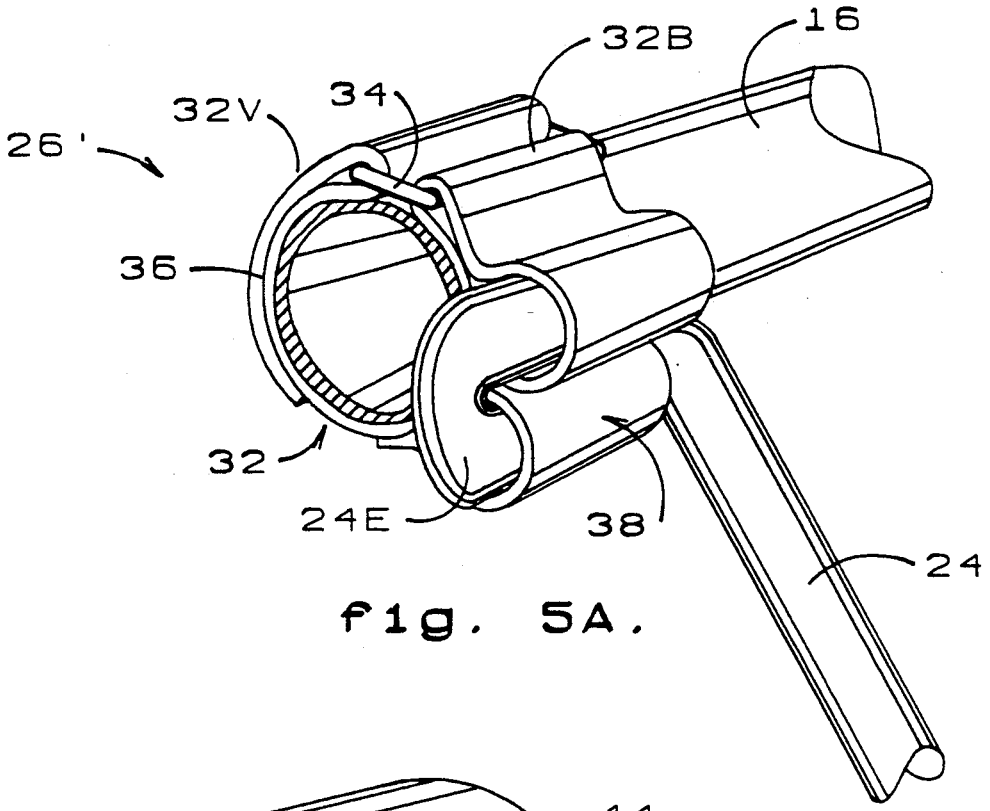
FIGS. 5A and 5B are close-up perspective views of two embodiments of attaching means which detachably secure the improved harness line ends to the boom.
Figure 5B:
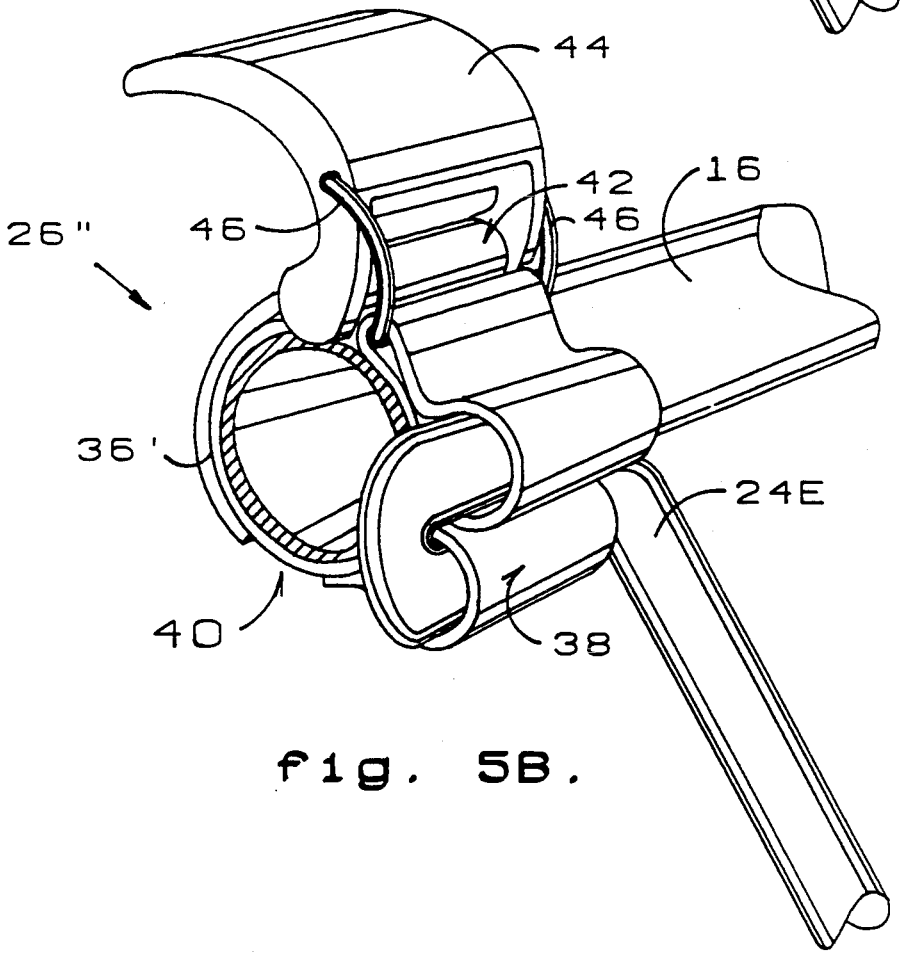

Illustrated in FIGS. 5A and 5B are close-up perspective views of detachable versions 26' and 26'' of attaching means 26. In each case, end 24E of harness line 24 is secured to boom 16 and held firmly in place by the detachable attaching means 26' and 26''.

Referring to the improved embodiment disclosed in FIG. 5A, attaching means 26' is composed of cincture 32 made of a sturdy flexible material such as nylon webbing. Buckle 34 is affixed to one end 32B of cincture 32. To a portion of the other end 32V of cincture 32 is adhered Velcro facing 36. End 24E of harness line 24 is secured to the body of cincture 32 at some point between cincture end 32B and cincture end 32V by a securing device 38. Harness line 24 is held firmly in position on boom 16 by wrapping cincture 32 tightly around boom 16 with end 32V being threaded through buckle 34 and folded back on itself and fixed to itself by means of Velcro facing 36.

As depicted in FIG. 5A, securing device 38 is formed of sewn webbing loops. Alternative modes of securing harness line end 24E to cincture 32 may be equally employed.

Referring now to the improved version of detachable attaching means disclosed in FIG. 5B, attaching means 26'' is composed of a size-adjustable C-shaped clamp body 40 having a diameter which approximates the diameter of boom 16. Fixed to one end of clamp body 40 by means of a flap having adhered Velcro facing 36' is a hinge 42. Hinge 42 joins clamp body 40 to one end of a curved lever arm 44. Lever arm 44 is disposed such that its curvature, when rotated to lie along the outside surface of clamp body 40, is concentric with the curvature of the clamp body. To the non-hinged end of clamp body 40 is attached an inelastic connecting ring 46. The opposite portion of connecting ring 46 is attached to lever arm 44 at some intermediate point along lever arm 44.

The assemblage hinge 42, lever arm 44 and connecting ring 46 effects an indirect coupling of the two ends of clamp body 40. These ends can be drawn to one-another by rotating lever arm 44 about hinge 42 which pushes the hinged clamp body end towards the non-hinged end at the same time as it pulls the non-hinged clamp body end towards the hinged end.

Harness line end 24E is fixed to clamp body 40 at some intermediate point between the hinged and non-hinged ends using securing device 38. As before, securing device 38 is shown as sewn webbing loops but may also take other forms. Harness line 24 is held in position on boom 16 by placing clamp body 40 around boom 16, threading Velcro faced flap 36' around hinge 42 and adhering flap 36' to itself. The size of clamp body 40 can be varied by varying the position of hinge 42 within the Velcro faced flap 36'. Once in position around boom 16, clamp body 40 is tightened and locked in place by rotating lever arm 44 around hinge 42 outward and backward until it lies alongside and adjacent the outside surface of clamp body 40.

Clamp body 40 can be constructed of a number of materials including, though not limited to, sturdy flexible materials such as nylon webbing and sturdy rigid materials such as molded plastic or metal. Also Velcro flap 36' can be mounted on the non-hinged end so to engage connecting ring 46 instead of hinge 42. In such an embodiment, clamp body 40 would become size adjustable from its opposite aspect.

According to either embodiment, harness line 24 can be moved to new positions longitudinally and radially on boom 16 by unbuckling buckle 34 in FIG. 5A, or by unlocking clamp body 40 in FIG. 5B, selecting new positions along boom 16 for attaching means 26' or 26'', respectively, and then re-buckling buckle 34 or re-clamping clamp body 40.

A further advantage of detachable attaching means 26'' is that, should it become unlocked during use, harness line end 24E will remain secured to boom 16 and can be moved and reclamped easily even while underway.

SUMMARY AND SCOPE

Thus as is readily seen the stiff downwardly curved harness line 24, held firmly outward by attaching means 26 at an appropriate orientation relative to harness hook 22, provides a reliable harness apparatus which is easily engaged and disengaged, and which is unlikely to engage by accident or otherwise interfere with the sailor's performance. The adjustable length telescoped embodiment disclosed in FIG. 4, together with the detachable attaching means 26' and 26" disclosed in FIGS. 5A and 5B, permit the sailor to adjust the size and position of harness line 24 according to the sailor's skill and equipment and the prevailing weather conditions.

Although the present invention has been described and illustrated in connection with a number of preferred embodiments, it is understood that modifications and variations may be resorted to without departing from the spirit of the invention, as those skilled in the art will readily understand. Such modifications and variations are considered to be within the purview and scope of the present invention as defined in the appended claims and their legal equivalents.

The embodiments of the invention which an exclusive property or privilege is claimed are defined as follows:

1. An improved harness line apparatus for wind propelled vehicles comprising:
   (a) an elongated U-shaped curvilinear harness line made of stiff and resilient material;
   (b) the ends of said harness line being secured to selected points along one side of a wishbone configured boom;
   (c) wherein at least one end of said harness line is secured to said boom by an attaching means which holds the harness line extending firmly outward from the boom towards the sailor for ease of use.

2. An improved harness line apparatus for wind propelled vehicles comprising:
   (a) an elongated U-shaped curvilinear harness line made of stiff and resilient material;
   (b) an attaching means for securing the ends of said harness line to selected points along one side of a wishbone configured boom;
   (c) said attaching means holding the harness line extending firmly outward from the boom towards the sailor for ease of use.

3. An improved harness line apparatus according to claim 1 wherein said attaching means holds the harness line firmly extending outward and downward relative to an upright sail such that the mid-point of the harness line where it engages the harness hook is in close proximity to the hook when the sailing vehicle is upright and the sailor is positioned upright on the vehicle.

4. An improved harness line apparatus according to claim 3 wherein the middle portion of said harness line is curved downward relative to the outer portions of said harness line such that the mid-point of the harness line where it engages the harness hook is positioned in close proximity to but slightly below the height of the harness hook when the sailing vehicle is upright and the sailor is positioned upright on the vehicle.

5. An improved harness line apparatus for wind propelled vehicles having an adjustable length comprising:
   (a) a plurality of tubing with dissimilar diameters partially telescoped inside one another to form a continuous elongated harness line;
   (b) an attaching means to secure the ends of said harness line to selected points along one side of a wishbone configured boom;
   (c) a continuous length of rope occupying the bore of the harness line and traversing the attaching means;
   (d) the ends of said rope being removably secured at points along the boom adjacent to said attaching means;
   (e) whereby the length of said harness line can be varied by varying the length of rope between said attaching means causing the sections of tubing to slide relative to one another.

6. An improved harness line apparatus having an adjustable length according to claim 5 wherein the harness line is composed of three sections of tubing, the middle section having an inside diameter slightly larger than the outside diameters of the outer sections of tubing.

7. An improved harness line apparatus having an adjustable length according to claim 5 wherein said tubing is stiff as well as resilient, and wherein said attaching means holds the harness line firmly to withstand gravitational and inertial forces and in a fixed orientation extending outward and downward relative to an upright sail such that the mid-point of the harness line where it engages the harness hook is in close proximity to the hook when the sailing vehicle is upright and the sailor is positioned upright on the vehicle.

8. An improved harness line apparatus having an adjustable length according to claim 7 wherein the middle portion of said harness line is curved downward relative to the outer portions of said harness line such that the mid-point of the harness line where it engages the harness hook is positioned in close proximity to but slightly below the height of the harness hook when the sailing vehicle is upright and the sailor is positioned upright on the vehicle.

9. An improved harness line apparatus according to claim 1 wherein said attaching means is detachable allowing the harness line to be repositioned on the boom.

10. An improved harness line apparatus according to claim 3 wherein said attaching means is detachable allowing the harness line to be repositioned on the boom.

11. An improved harness line apparatus according to claim 4 wherein said attaching means is detachable allowing the harness line to be repositioned on the boom.

12. An improved harness line apparatus according to claim 10 wherein said detachable attaching means comprises:
   (a) a flexible cincture;
   (b) one end of the harness line being secured to the body of said cincture;
   (c) a buckle affixed to one end of said cincture,
   (d) Velcro facing mounted along a portion of the opposite end of said cincture;
   (e) whereby the harness line is held firmly in place on the boom by wrapping said cincture firmly around the boom and detachably securing the cincture to itself by threading the Velcro faced end through said buckle and back on itself.

13. An improved harness line apparatus according to claim 9 wherein said detachable attaching means is a clamping mechanism which locks around the boom.

14. An improved harness line apparatus according to claim 10 wherein said detachable attaching means is a clamping mechanism which locks around the boom.

15. An improved harness line apparatus according to claim 11 wherein said detachable attaching means is a clamping mechanism which locks around the boom.

16. An improved harness line apparatus according to claim 14 wherein said clamping mechanism comprises:
   (a) a C-shaped clamp body which encircles the boom and to which the harness line end is affixed;
   (b) a curved lever arm joined to one end of said clamp body by way of a hinge such that, when the lever arm is rotated to lie along the outside of the clamp body, the curvature of the lever arm is concentric with the curvature of the clamp body;

(c) said lever arm being coupled to the non-hinged end of said clamp body by means of an inelastic connecting ring;

(b) whereby the clamp body is tightened and locked firmly around the boom by rotating said hinged lever arm outward and backward until it lies alongside and adjacent to the outer surface of said clamp body.

17. An improved harness line apparatus according to claim 16 wherein said C-shaped clamp body is size-adjustable.

18. An improved harness line apparatus according to claim 17 wherein said C-shaped clamp body is made size-adjustable by having a Velcro faced flap at the hinged end, said flap being threaded through said hinge, folded back on itself and adhered to itself by means of the Velcro material.

19. An improved harness line apparatus according to claim 17 wherein said C-shaped clamp body is made size-adjustable by having a Velcro faced flap at the non-hinged end, said flap being threaded through said connecting ring, folded back on itself and adhered to itself by means of the Velcro material.

* * * * *